United States Patent [19]

Hickey

[11] Patent Number: 4,667,964

[45] Date of Patent: May 26, 1987

[54] GOLF GAME APPARATUS

[76] Inventor: Charles P. Hickey, 1904 - 27 St., Monroe, Wis. 53566

[21] Appl. No.: 834,613

[22] Filed: Feb. 28, 1986

[51] Int. Cl.[4] ..... A63B 69/36

[52] U.S. Cl. ..... 273/176 E; 273/180; 273/181 A

[58] Field of Search ..... 273/176 AA, 176 AB, 273/176 B, 176 E, 176 F, 178 R, 178 A, 180, 176 R, 176 G, 181 A, 87 B, 87 C, 183 A, 195 R

[56] References Cited

U.S. PATENT DOCUMENTS

| | | | |
|---|---|---|---|
| 1,763,243 | 6/1930 | MacFadden | 273/176 F |
| 3,114,556 | 12/1963 | Miller | 273/178 R |
| 3,342,494 | 9/1967 | Talley | 273/183 A X |
| 3,348,846 | 10/1967 | Atchison | 273/181 A X |
| 3,610,631 | 10/1971 | Mulherin | 273/176 AA |
| 3,844,565 | 10/1974 | Gigliotti | 273/176 F |
| 3,858,888 | 1/1975 | Young | 273/176 AA |

*Primary Examiner*—George J. Marlo

*Attorney, Agent, or Firm*—Andrus, Sceales, Starke & Sawall

[57] ABSTRACT

A golf game apparatus is provided which includes a plurality of pieces of equipment including: golf clubs (10); a plurality of multi-sided goals (21), each of which includes a plurality of ball entrances (29, 30); balls (11); and markers (12–16) for use in tee-off, as well as out-of-bounds, ball and right and left dogleg markers. Each of the goals includes a generally triangular lower base (23) having raised corner portions and a hexagon-shaped central piece (26) adapted to rest on the playing surface (34). An upper goal portion includes a triangular pyramid having trapezoid-shaped sides (28), with each of the three sides having an opening (29) forming a ball entrance. The top edges (31) of the sides also form a ball opening (30). Lips (32) on the lower base adjacent the side wall openings (29) form a dividing line for determining whether a ball is actually positioned within the goal or not. The goal side walls and openings therein are arranged in non-parallel planes. The goals and tee-off markers are provided with sets of indicia thereon, one indicia for each goal side opening. Each tee-off marker has the same number of indicia as a goal. The various indicia on each goal are duplicated on the tee-off markers, but not necessarily in the same set arrangement.

13 Claims, 5 Drawing Figures

GOLF GAME APPARATUS

BACKGROUND AND SUMMARY OF THE INVENTION

This invention relates to a golf game apparatus. More particularly, the invention is directed to an apparatus which allows children and/or adults to play a golf-like game in the backyard or possibly in the living room or family room. Although the game is played very much like regular golf with numerous tee-offs and targets, the game may be played in a much smaller area than on a standard golf course and with all the fun and advantages of the real game.

Although miniature and full-sized golf courses abound throughout this country, the inventor is unaware of any apparatus which even begins to approach the concepts which are set forth below.

It is an object of the present invention to provide a golf game apparatus which may be quickly set up on and taken down from a playing area of relatively small size, and which may be easily transported and stored. It is a further object of the invention to provide such an apparatus which may be inexpensively manufactured. Yet another object is to eliminate the need for target holes to be dug in the ground or otherwise formed in the playing surface for a golf ball to fall downwardly into. Another object is to make it possible to play a golf game which has most of the features of regular golf, without some of the disadvantages thereof.

In accordance with the various aspects of the invention, a golf game apparatus is provided which includes a plurality of pieces of equipment including: golf clubs (optional if players have their own clubs); a plurality of multi-sided goals, each of which includes a plurality of ball entrances; balls; and markers for use in tee-off, as well as out-of-bounds, ball and right and left dogleg markers.

In the present embodiment, each of the goals includes a generally triangular two-piece lower base having raised corner portions and a hexagon-shaped central piece adapted to rest on the playing surface. An upper goal portion includes a triangular pyramid having trapezoid-shaped sides, with each of the three sides having an opening forming a ball entrance. The top edges of the sides also form a ball entrance opening. Lips on the lower base adjacent the side wall openings form a dividing line for determining whether a ball is actually positioned within the goal chamber or not, for scoring purposes. The goal side walls and openings therein are arranged in non-parallel planes so that a ball that enters one opening is normally prevented from exiting one of the other openings and is captured within the goal.

Various sets of markers are provided, each set being visually distinguishable and designated by shape or color. In the present embodiment, the tee-off, out-of-bounds and right and left dogleg markers are similarly shaped and are designated by different colors. These markers are shown as formed of a base for resting on the playing surface, and an upwardly extending portion to enhance visibility. The ball markers are normally designated by color and comprise a thin disk used as a substitute for a ball that is in the way of another player's ball.

The goals and tee-off markers are provided with sets of indicia thereon, one indicia for each goal side opening. Each tee-off marker has the same number of indicia as a goal. The various indicia on each goal are duplicated on the tee-off markers, but not necessarily in the same set arrangement.

In the contemplated set-up of the present embodiment, the out-of-bounds markers are arranged to delineate the player area. Within that area, the goals are spaced apart triangularly, as are the tee-off markers. The object is to tee-off from a tee-off marker having a given indicia and cause the ball to enter an opening in the goal which has the same indicia on it, among others. The various left and right doglegs are suitably positioned so as to form obstacles so that the player must often take a non-linear path from the tee-off marker to the goal. The indicia are such that the player proceeds from goal to goal in some sort of order based on the order of the indicia, such as ascending numbers or letters or the like. The winner among a group of players is, as in regular golf, the player who traverses the entire course with the minimum number of strokes.

The ball may also enter the top goal opening, which if done in a single stroke from the respective tee-off marker, would be a hole-in-one.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
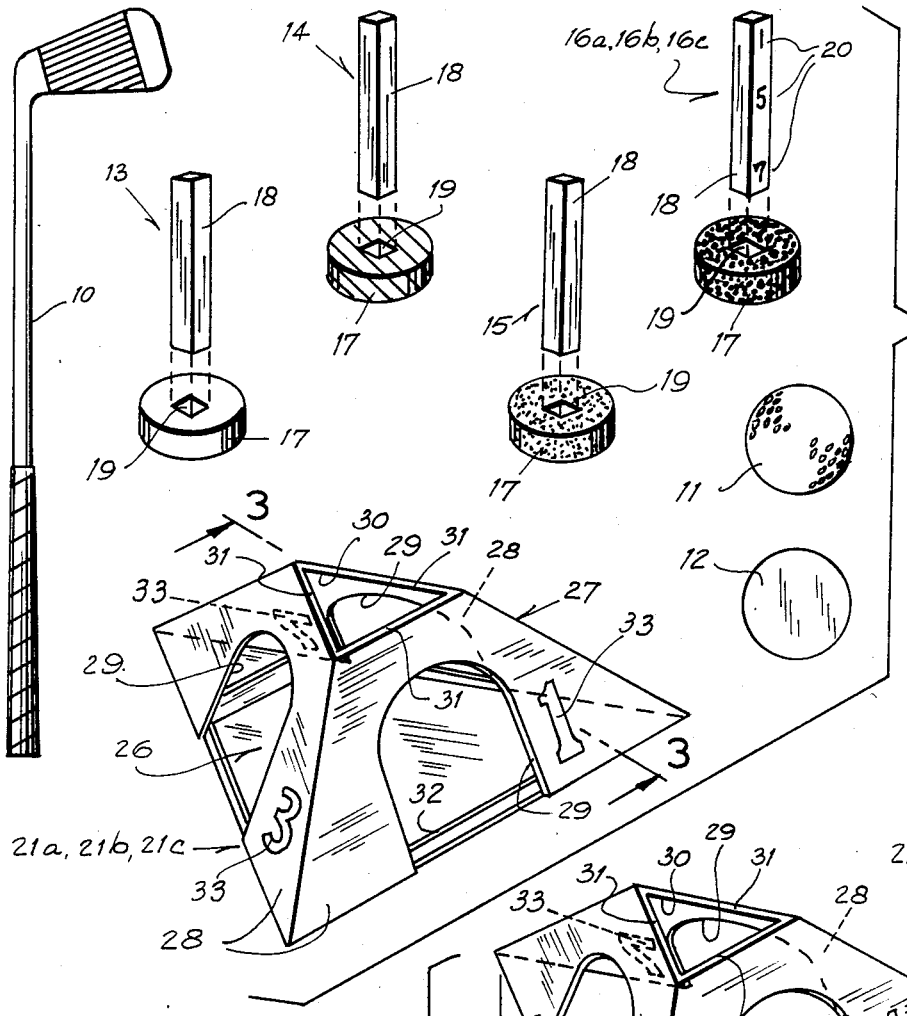
FIG. 1 is a perspective view of the various pieces of equipment utilized in the game.

FIG. 1 illustrates the various pieces of equipment comprising the golf game apparatus. As shown, the apparatus may include a plurality of golf clubs 10 which may be made of plastic and configured in the shape of a 9-iron. Alternatively, the players may use their own clubs. The number of clubs 10 will most likely depend on the number of players.

In addition, the apparatus includes a series of balls 11, one for each player. The balls may be enlarged and of plastic and suitably differentiated from each other, as by color differences, so that each player's ball may be easily identified. These, too, may be supplied by the players if desired. The apparatus is further contemplated as including a set of disk-like ball markers 12, which may also be of varying colors to match the ball colors. Markers 12 may be substituted for a player's ball if the ball is in the way of another player's ball during the game.

Additional sets of markers are also provided, with these markers preferably being easily visible from a distance and visually distinguishable from each other, either by shape or color or the like. One set is of out-of-bounds markers 13, which could be white and which delineate the playing area. Another set is of left dogleg markers 14 for positioning on the playing area. Markers 14 could be yellow for example, but are shown with shading lines. Another set is of right dogleg markers 15, also for positioning on the playing area. Markers 15 could be orange for example, but are shown with stippling.

A further set of markers is provided for tee-off purposes. These markers are designated as 16*a*, 16*b* and 16*c* and are shown as being black.

Markers 13 through 16 are illustrated as all being physically similar, although this need not be the case. The markers may be of foam plastic material and, as shown, comprise a base 17 and an upwardly extending more visible portion such as a post 18 inserted into an opening 19 in the base.

Tee-off markers 16 are shown as having a plurality of indicia 20 thereon, for purposes to be more fully explained hereinafter.

Finally, the apparatus of the invention includes a plurality of goals, designated as 21*a*, 21*b* and 21*c*, which in this embodiment correspond in number to the number of tee-off mrkers 16, namely three. Each goal 21 is contemplated as being similar in construction so that only one goal will be described in detail.

Figure 2:
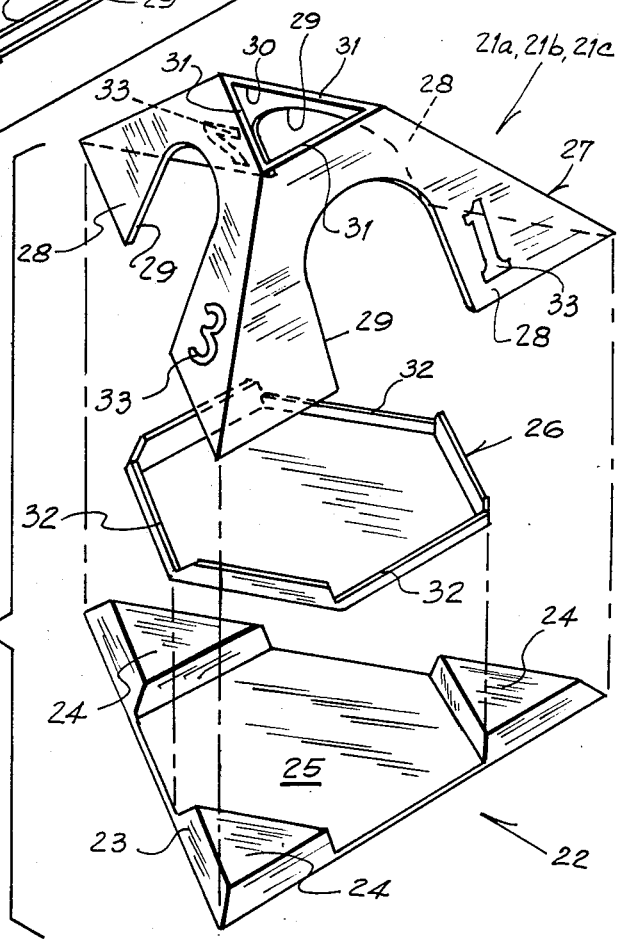
FIG. 2 is an exploded perspective view of one of the goals.
Figure 3:
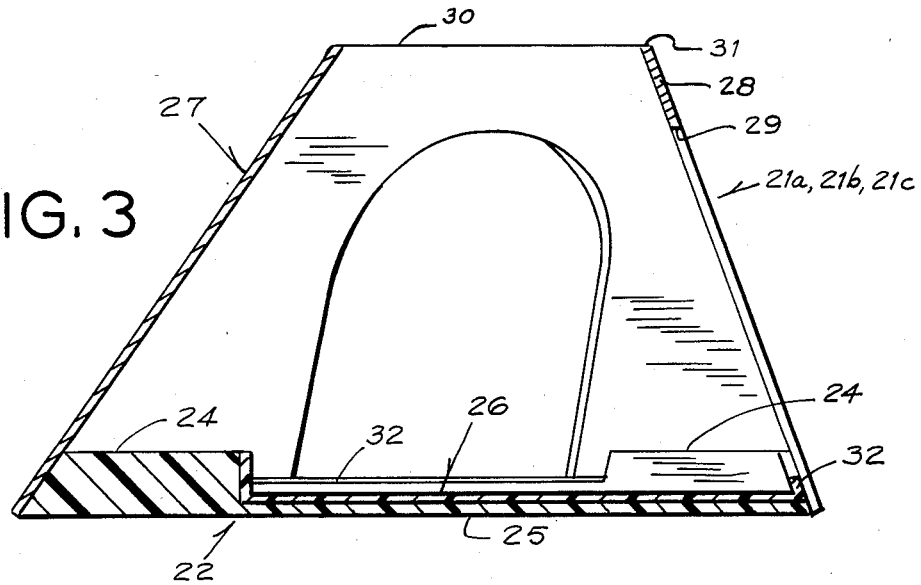
FIG. 3 is a transverse section of one of the goals, taken on line 3—3 of FIG. 1.

As shown in FIGS. 1–3, each goal 21 may be made of light-weight plastic and comprises a support 22 which includes a triangular lower base 23 having raised portions 24 at its corners and which are joined by a connector 25. The elements of lower base 23 are joined so as to form an inner recess which is adapted to receive a hexagonally shaped central piece 26 which in turn serves as a ball-receiving surface. The upper portion of goal 21 fits down over the base 23 and comprises a pyramid 27 formed of three trapezoid-shaped side walls 28 joined together at their generally vertical side edges. Pyramid 27 includes means for receiving a ball 11 therethrough. For this purpose, each goal side wall 28 is provided with an access opening 29 through which a ball 11 may enter upon being struck by a selectively aimed club 10. A further access opening 30 is formed at the top of pyramid 27 by the co-joined top edges 31 of side walls 28. The goal thus has an internal chamber having four entrances facing in a plurality of different directions.

For purposes of determining whether a ball 11 is within the confines of a goal 21, or is still outside it, means are provided along the lower edge of each side wall opening 29 to provide a dividing line. In the present embodiment, this means comprises generally upwardly extending lips 32 disposed on the edges of hex-shaped central piece 26 between raised corner portions 24. It has been found that a lip of approximately $\frac{1}{8}''$ height is very adequate for the intended purpose.

FIGS. 1–3 of the drawings make it abundantly clear that side walls 28 and thus access openings 29 are disposed in non-parallel planes. Thus, openings 29 are out of cross alignment so that a ball 11 that enters one opening 29 at a high velocity and crosses center piece 26 will normally engage an opposed side wall or walls 28 instead of exiting another opening; there being no two openings in opposed relationship.

In addition, since access openings 29 and 30 are all above the pyramid support 22 so that a ball reaches its "hole" above the level of the playing surface, there is no need to provide holes below the playing surface into which the ball drops.

The apparatus is intended to provide a simulated golf course. Thus, the number of effective tee-offs and access openings should be such as to permit playing either a 9-hole or 18-hole game. The present embodiment illustrates a 9-hole course.

Figure 4:
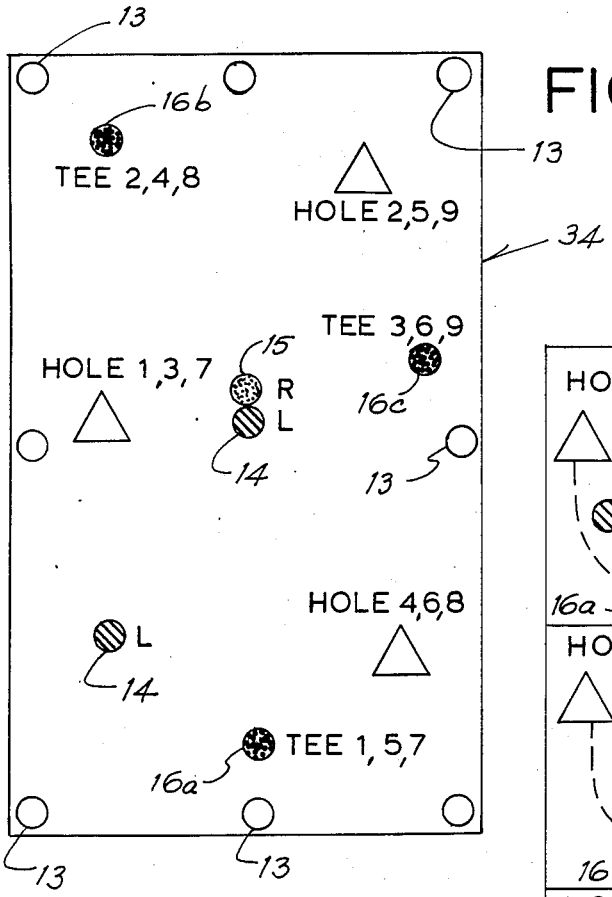
FIG. 4 is a schematic showing of an entire playing area.

Referring to FIGS. 1 and 4, tee-off markers 16*a*, 16*b* and 16*c* each are provided with a plurality of indicia 20, as previously mentioned. These indicia are adapted to represent hole numbers. Likewise, each goal 21*a*, 21*b* and 21*c* is also provided with a set of indicia 33. By providing a plurality indicia on each of the tee-off markers 16 and goals 21, it is possible to simulate a full length golf course within a relatively small playing area.

Thus, there are only three tee-off markers, each with a set of three indicia so that a total of nine holes is represented. In addition, there are only three goals, with an indicia on each of the three side walls 28 thereof to represent the nine side access openings 29 or "holes". Top openings 30 increase the number of access openings available, as will be explained.

Before beginning a detailed description of the correlation between the indicia and the elements to which the indicia are applied, it should be pointed out that the indicia may be numbers or letters or the like which are in some sort of order, such as ascending or descending. Since the game of golf usually utilizes ascending numbers for the various holes to be played, that is the way the indicia is described herein. Other equivalents are intended to be covered by such language.

Again referring to FIGS. 1 and 4, the tee-off marker specifically illustrated in FIG. 1 is actually marker 16*a*, having indicia 20 comprising the non-sequential numerals 1, 5 and 7 disposed thereon, representing golf holes having the same numerals. See FIG. 4, where the tee-off marker 16*a* is schematically illustrated, with the same indicia numerals also shown. Also in FIG. 4, tee-off marker 16*b* is shown as having the non-sequential numerals 2, 4 and 8 disposed thereon, while marker 16*c* has the non-sequential numerals 3, 6 and 9 thereon. Thus golf tee-offs 1–9 are fully represented by the three tee-off markers 16.

Likewise, the goal specifically illustrated in FIG. 1 is actually goal 21*a*, having indicia 33 comprising the numerals 1, 3 and 7 disposed thereon. See also FIG. 4 where goal 21*a* is schematically illustrated, with the same indicia numerals also shown. Also in FIG. 4, goal 21*b* is shown as having the non-sequential numerals 2, 5 and 9 thereon, while goal 21*c* has the non-sequential numerals 4, 6 and 8 thereon. Thus the desired nine golf holes are fully represented by the three goals 21.

Note that each set of three indicia 20 on any given tee-off marker 16 is not duplicated by any set of three indicia 33 on any goal 21. This lack of correspondence of sets permits maximum variation in the play for the various holes. However, the total indicia 20 on all of tee-off markers 16 provide a sequential series of indicia (1 through 9) equivalent to the number (9) of the ball access openings 29 in goal side walls 28.

FIG. 4 schematically illustrates a set-up of the golf game apparatus of the present embodiment. The game is to be played on a suitable somewhat elongated surface 34 such as a backyard or large room, the area of which is delineated by the out-of-bounds markers 13. Tee-off markers 16 are arranged on the playing surface in a generally triangular manner, as are goals 21. Left and right dogleg markers 14 and 15 are also strategically positioned on the playing surface 34.

In commencing the game, the players choose their clubs and ball colors and begin to tee-off in succession from tee-marker 16*a* having indica numeral 1 thereon. The object is for this player to place his ball within the confines of goal 21*a* which also has indicia numeral 1 thereon. In the preferred way of playing, the player may successfully access goal 21*a* from any direction through any opening 29 or 30. In another way of playing, the player may only successfully access goal 21*a* through the opening 29 having the indicia numeral 1 disposed closest thereto, or through the top opening 30, through which a ball may also be retrieved. The number of strokes necessary for successful access is of course kept track of, and a par system may also be utilized. The other players commence playing on any desired rotating basis.

Once a player has effectively "put his ball in hole 1", he then proceeds from goal 21*a* to tee-marker 16*b* which has the indicia numeral 2 disposed thereon, and then tees off toward goal 21*b* which has indicia numeral 2 also disposed thereon. Upon successful completion of "hole 2", he proceeds to play for "hole 3", and so on until all nine "holes" have been completed.

During play, the player cannot normally aim in a straight linear path from the respective marker to the goal. He must aim his various strokes or shots to bypass the various doglegs 14 and 15.

Figure 5:
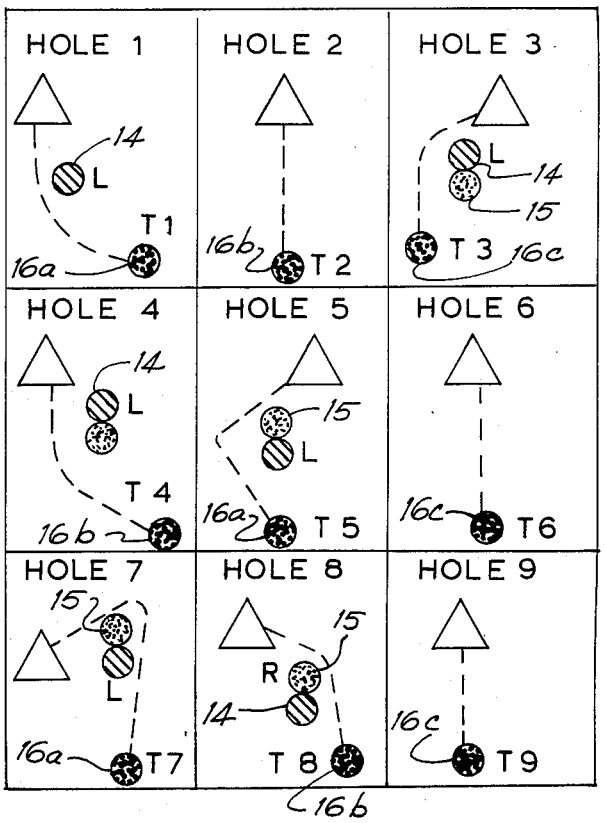
FIG. 5 is a schematic layout showing the ball paths between tee-off markers and the respective goals in a "9-hole" game.

FIG. 5 illustrates a number of plays during a golf game using the apparatus of the invention. While each play is not completely identical to those which may be required in the set-up of FIG. 4, they are sufficiently similar so that many of the plays can be compared in both figures.

During the game, many of the usual rules applying to a full-scale golf may be utilized. Such rules need not be detailed here, but may include rules relating to order of play, out-of-bounds, contact between two balls, ball close to an obstacle, etc. Also, as previously mentioned, ball markers 12 may be substituted for balls which themselves present an obstacle to another player's ball.

The golf game apparatus of the present invention provides for a game which very closely approaches actual golf. However, the present apparatus permits playing a full 9 or more holes within a much smaller playing area, and even indoors. The apparatus is light in weight and easily portable, and relative inexpensive to manufacture, such as out of molded plastic or the like. An extra bit of fun is created by the top access openings 30 which provide an additional means for accessing the interior of a goal 21. It is almost impossible to intentionally shoot a ball through a top opening 30, so that when a ball does go through the top it is almost invariably accidental. Such occurrences are most likely when shooting from a maximum distance, such as from a tee-off marker, so that there is the double pleasure of surprise and a hole-in-one.

Various modes of carrying out the invention are contemplated as being within the scope of the following claims particularly pointing out and distinctly claiming the subject matter which is regarded as the invention.

I claim:

1. A golf game apparatus comprising, in combination:

(a) a set of tee-off markers (16) for placing in spaced relationship from each other on a playing surface (34) and with each said marker having a plurality of first indicating means (20) for designating a plurality of holes toward which a ball (11) is to be selectively aimed, (b) and a plurality of goals (21) for placing in spaced relationship from each other on the playing surface and with each said goal having multiple ball access openings (29, 30) facing in a plurality of different directions, (c) each said goal having a plurality of second indicating means (33) corresponding to the said first indicating means on one or more of said tee-off markers (16) thereby designating the corresponding hole and goal opening to be played from a given tee-off marker.

2. The golf game apparatus of claim 1 wherein said multiple access openings (2, 30) of said goals (21) are disposed above the level of the playing surface (34) when said goals are placed on said surface.

3. The golf game apparatus of claim 2 wherein at least some of said ball access openings (29) of a said goal (21) are disposed in a plurality of goal side walls (28).

4. The golf game apparatus of claim 3 in which said goal side walls (28) are disposed in non-parallel planes.

5. The golf game apparatus of claim 3 wherein any two ball access openings (29) of a said goal (21) are out of diametric alignment with each other so that a ball entering one of said two openings is prevented from discharging through the other of said two openings and normally is captured within the goal.

6. The golf game apparatus of claim 3 wherein said side walls (28) of a said goal (21) are formed to provide a ball access opening (30) disposed in the top of the goal.

7. The golf game apparatus of claim 6:

(a) wherein said goal side walls (28) are trapezoid-shaped and are joined together along their side edges, (b) and said side walls include top edges (31) forming said top ball access opening (30).

8. The golf game apparatus of claim 3:

(a) wherein said side walls (28) of a said goal (21) form an internal goal chamber, (b) and which includes lip means (32) disposed at the lower ends of said side wall openings (29) for designating whether or not a ball has entered said chamber.

9. The golf game apparatus of claim 3 wherein a said goal (21) includes:

(a) a triangular base (23) having raised corners (24), (b) a hexagonal center member (26) disposed within said base, (c) a pyramidal upper goal portion formed by said side walls (28) and disposed on said base and forming an internal goal chamber, (d) and lip means (32) disposed on said center member (26) adjacent said side wall openings (29) for designating whether or not a ball has entered said chamber.

10. The golf game apparatus of claim 3 wherein:

(a) said first indicating means on a said tee-off marker (16) comprises a set of non-sequential indicia (20), (b) said second indicating means on a said goal (21) comprises a set of non-sequential indicia (33), (c) and the sets of indicia (33) on said goals (21) are out of correspondence with the sets of indicia (200 on said tee-off markers (16).

11. The golf game apparatus of claim 10 wherein the total indicia (20) on all of said tee-off markers (16) provide a sequential series of indicia equivalent to the number of ball access openings (29) in said goal side walls (28).

12. The golf game apparatus of claim 1 which further comprises:

(a) a set of out-of-bounds markers (13), (b) a set of left dogleg markers (14), (c) and a set of right dogleg markers (15);

(d) each said set of markers (13–16) being visually distinguishable from the other said sets.

13. The golf game apparatus of claim 1 wherein said sets of tee-off markers (16) and goals (21) are arranged triangularly on the playing surface (34).

* * * * *